US006953317B2

(12) United States Patent
Ikegami et al.

(10) Patent No.: US 6,953,317 B2
(45) **Date of Patent: *Oct. 11, 2005**

(54) TURBO-MOLECULAR PUMP

(75) Inventors: Tetsuma Ikegami, Yokohama (JP); Matsutaro Miyamoto, Chigasaki (JP); Hiroyuki Kawasaki, Chigasaki (JP)

(73) Assignee: Ebara Corporation, Tokyo (JP)

( * ) Notice: Subject to any disclaimer, the term of this patent is extended or adjusted under 35 U.S.C. 154(b) by 192 days.

This patent is subject to a terminal disclaimer.

(21) Appl. No.: 09/984,773

(22) Filed: Oct. 31, 2001

(65) Prior Publication Data

US 2002/0028132 A1 Mar. 7, 2002

Related U.S. Application Data

(62) Division of application No. 09/104,171, filed on Jun. 25, 1998, now Pat. No. 6,332,752.

(30) Foreign Application Priority Data

Jun. 27, 1997 (JP) ..... 9-187681
Jan. 27, 1998 (JP) ..... 10-29160

(51) Int. Cl.[7] ..... F04O 19/04
(52) U.S. Cl. ..... 415/9; 415/90; 415/143
(58) Field of Search ..... 415/9, 90, 143; 417/423.4

(56) References Cited

U.S. PATENT DOCUMENTS 998,820 A 7/1911 Westinghouse
1,925,898 A 9/1933 Fritz
3,749,528 A 7/1973 Rousseau et al.
4,309,143 A 1/1982 Klatt et al.
4,449,888 A 5/1984 Balje
4,502,832 A 3/1985 Becker
4,579,508 A 4/1986 Tsumaki et al.
4,787,829 A 11/1988 Miyazaki et al.
4,797,062 A * 1/1989 Deters et al. ..... 415/90
4,830,584 A 5/1989 Mohn
5,273,393 A 12/1993 Jones et al.
5,528,618 A 6/1996 Schlie et al.
5,599,111 A 2/1997 Miyazaki et al.
6,332,752 B2 * 12/2001 Ikegami et al. ..... 415/90

FOREIGN PATENT DOCUMENTS

DE 2 214 702 A 9/1973
DE 25 23 390 B 5/1976
DE 25 49 700 A 11/1976
GB 2 058 245 A 4/1981

(Continued)

*Primary Examiner*—Christopher Verdier
(74) *Attorney, Agent, or Firm*—Westerman, Hattori, Daniels & Adrian, LLP

(57) ABSTRACT

A very safe and reliable turbo-molecular pump has been developed so that if an abnormal condition should develop on the rotor structure, it will not lead to damage to the stator or pump casing to cause a loss of vacuum in a vacuum processing system. The turbo-molecular pump has a pump casing housing a stator and a rotor therein, a vane pumping section and/or a groove pumping section formed by the stator and the rotor, and a constriction releasing structure for releasing the constriction of at least a part of the stator when an abnormal torque is applied to the stator by the rotor.

30 Claims, 10 Drawing Sheets

FOREIGN PATENT DOCUMENTS

| | | |
|---|---|---|
| GB | 2069629 | 8/1981 |
| JP | 57-212395 | 12/1982 |
| JP | 59-153988 | 9/1984 |
| JP | 61-10994 | 1/1986 |
| JP | 63-255594 | 10/1988 |
| JP | 64-29695 A | 1/1989 |
| JP | 64-41698 | 2/1989 |
| JP | 1-113191 | 7/1989 |
| JP | 1-190990 | 8/1989 |
| JP | 1-190991 A | 8/1989 |
| JP | 4-66395 | 6/1992 |
| JP | 4-330397 | 11/1992 |
| JP | 5-36094 | 5/1993 |
| JP | 6-4392 | 1/1994 |
| JP | 8-68389 | 3/1996 |
| JP | 8-144992 | 6/1996 |
| JP | 10-274189 | 10/1998 |
| JP | 11-62879 | 3/1999 |
| JP | 11-93889 | 4/1999 |

* cited by examiner

TURBO-MOLECULAR PUMP

This application is a division of prior application Ser. No. 09/104,171, filed on Jun. 25, 1998, which matured into U.S. Pat. No. 6,332,752.

BACKGROUND OF THE INVENTION

1. Field of the Invention

The present invention relates to a turbo-molecular pump for evacuating gas by using a high speed rotor.

2. Description of the Related Art

An example of a conventional turbo-molecular pump is shown in FIG. 13. The pump comprises a cylindrical pump casing 14 housing a vane pumping section $L_1$ and a groove pumping section $L_2$ which are comprised of a rotor (rotation member) R and a stator (stationary member) S. The bottom portion of the pump casing 14 is covered by a base section 15 which is provided with an exhaust port 15*a*. The top portion of the pump casing 14 is provided with a flange section 14*a* for coupling the pump to an apparatus or a piping to be evacuated. The stator S comprises a stator cylinder section 16, fixed sections of the vane pumping section $L_1$ and the groove pumping section $L_2$.

The rotor R comprises a rotor cylinder section 12 attached to a main shaft 10, which is inserted into the stator cylinder section 16. Between the main shaft 10 and the stator cylinder section 16 are constructed a drive motor 18, an upper radial bearing 20 and a lower radial bearing 22 disposed on the upper and lower sides of the drive motor 18 respectively. Under the main shaft 10, there is an axial bearing 24 having a target disk 24*a* at the bottom end of the main shaft 10 and upper and lower electromagnets 24*b* on the stator side. In this; configuration, high speed rotation of the rotor R is supported by a five coordinate active control system.

Rotor vanes 30 are provided integrally with the upper external surface of the rotor cylinder section 12 to form an impeller, and on the inside of the casing 14, stator vanes 32 are provided in such a way to alternately interweave with the rotor vanes 30. These vane members constitute the vane pumping section $L_1$ which carries out gas evacuation by cooperative action of the high speed rotor vanes 30 and the stator vanes 32. Below the vane pumping section $L_1$, the groove pumping section $L_2$ is provided. The groove pumping section $L_2$ is comprised by a spiral groove section 34 having spiral grooves 34*a* on the outer surface of the bottom end of the rotor cylinder section 12, and a spiral groove section spacer 36 surrounding the spiral groove section 34 of the stator S. The gas evacuation action of the groove pumping section $L_2$ is due to the dragging effect of the spiral grooves 34*a* against gases.

By providing the groove pumping section $L_2$ downstream of the vane pumping section $L_1$, a wide-range turbo-molecular pump can be constructed so as to enable evacuation over a wide range of gas flow rates using one pumping unit. In this example, the spiral grooves of the groove pumping section $L_2$ are provided on the rotor side of the pump structure, but some pumps have the spiral grooves formed on the stator side of the pump structure.

Such turbo-molecular pumps are assembled as follows. Firstly, the groove pumping section spacer 36 is attached by coupling the lower surface of the step 36*a* to the protruded ring section 15*b* formed on the base section 15. Next, the rotor R is fixed in some position, and the stator vanes 32, which are normally split into two half sections, are clamped around to interweave between the rotor vanes 30. This is followed by placing a stator vane spacer 38, having steps on its top and bottom regions, on top of the clamped rotor vane 30. This assembling step is repeated for each rotor vane 30 to complete the assembly of the stator vanes 32 around the rotor R.

Lastly, the pump casing 14 is attached by sliding it around the layered stator vane structure and fixing the flange 14*b* to the base of the stator S by fasteners such as bolts, thereby pressing the top stator vane spacer 38 firmly against the stepped surface 14*c* on the inside surface of the casing 14 and binding the entire layered assembly and the groove pumping section spacer 36. It can be understood from this assembly structure that the peripheries of each of the stator vanes 32 are pressed together by stator vane spacers 38 located above and below, and similarly the groove pumping section spacer 36 is pressed down by the lowermost stator vane 32, stator vane spacer 38 and the protrusion section 15*b* of the base section 15, so that the axially applied pressing force prevents induced rotation of the stator vanes 32 and the groove pumping section spacer 36 with the rotor R in the circumferential direction.

Also, though not shown in the drawing, sometimes the groove pumping section spacer 36 is fastened to the stator cylinder section 16 of the stator S by bolts to assure the fixation.

In such turbo-molecular pumps, operational difficulties are sometimes encountered, such as abnormal rotation caused by the eccentricity of rotor R, and they may be accompanied by some damaging of the rotor vanes 30. In such a case, the stator structure can also be subjected to significant circumferential or radial force by the rotor R and its debris, which may impact on not only the stator vanes 32 but the stator vane spacers 38 and the groove pumping section spacer 36.

These abnormal operating conditions can cause not only deformation of the stator vanes 32 and spacers 36, 38, but can cause fracture of casing 14 and stator cylinder section 16, or damage to their joints or severing of vacuum connections attached to the pump. Such damage and severing to any parts of the stator S cause breakage of vacuum in the whole processing system connected to and evacuated by the pump not only to damage the system facilities and in-process goods, but also to lead to accidental release of gases in the system to outside environment.

SUMMARY OF THE INVENTION

It is an object of the present invention to provide a very safe and reliable turbo-molecular pump so that if an abnormal condition should develop on the rotor structure, it will not lead to damage to the stator or pump casing to cause the loss of vacuum in a vacuum processing system.

The object has been achieved in a turbo-molecular pump comprising: a pump casing housing a stator and a rotor therein; a vane pumping section and/or a groove pumping section comprised by the stator and the rotor; and a constriction releasing structure for releasing the constriction of at least a part of the stator when an abnormal torque is applied to the stator by the rotor.

Accordingly, when an abnormal torque is applied to a stator side of the pump structure due to some abnormal condition developing in the rotor structure, the constriction releasing structure acts to loosen the stator structure so that the rotation energy of the rotor is absorbed and transmission of torque to the pump casing is prevented and damage to pump casing and vacuum connection can be avoided. The constriction releasing structure is normally provided on the stator side of the pump structure, i.e., fixed vanes and structures for fixing the groove pumping section spacer to the pump casing.

The stator may be comprised by a plurality of stator elements, and the constriction releasing structure may be provided in a fixation structure for mutually fixing the stator elements.

The constriction releasing structure may be a fragile section provided on a stator side of the pump structure. Accordingly, the rotation energy of the rotor is absorbed by fracture of the fragile section, thereby reducing the effects of abnormal torque on the pump casing.

The stator elements may be provided with a flange section for their fixation, and the fragile section may be formed in the flange section. Accordingly, transmission of abnormal torque to the pump casing is prevented by a fracture along the fragile section in the groove pumping section in the stator, which can be readily deformed outward.

In another aspect of the invention, the turbo-molecular pump comprises: a pump casing housing a stator and a rotor therein; a vane pumping section and/or a groove pumping section comprised by the stator and the rotor; and a friction reducing structure provided in at least a part of a space between the stator and the pump casing. Accordingly, friction between the stator and the pump casing is reduced, and it is more difficult to transmit rotational torque on the stator to the pump casing, thereby preventing abnormal torque to be transmitted to the casing. For example, in addition to an inherently low friction material such as polytetrafluoroethylene, low-friction structures comprised by ball bearings or rod bearings may also be used.

In another aspect of the invention, the turbo-molecular pump comprises: a pump casing housing a stator and a rotor therein; a vane pumping section and/or a groove pumping section comprised by the stator and the rotor; and an impact absorbing structure provided in at least a part of a space between the stator and the pump casing. In this type of pump, because impact transmitted from the rotor to the stator is absorbed by the impact absorbing structure, it is possible to prevent abnormal torque from being transmitted to the pump casing. Such impact absorbing structure can be comprised by relatively soft metallic materials, polymeric materials or a mixture thereof. Additionally, by combining such materials with a relatively tough material, a composite material may be used to combine an impact absorbing function and shape retaining function.

The stator of a cylindrical shape to comprise the groove pumping section may be secured to the pump casing in such a way that, the stator is attached firmly at an exhaust end of the groove pumping section, but at an intake end of the groove pumping section, a stator wall is attached to the pump casing so as to leave a clearance between it and the pump casing. Accordingly, the bottom end of the stator comprising the groove pumping section which can be readily deformed outward is separated from the casing so that transmission of abnormal torque to the pump casing can be prevented.

The friction reducing structure may be comprised by a mechanical bearing sleeve means having an inner sleeve and an outer sleeve wherein an inner sleeve thickness is larger than an outer sleeve thickness. Accordingly, by increasing the toughness of the inner bearing member, the bearing device can perform its friction reducing function without losing its rotational capability.

DESCRIPTION OF THE PREFERRED EMBODIMENTS

In the following, preferred embodiments will be presented with reference to the drawings.

Figure 1:
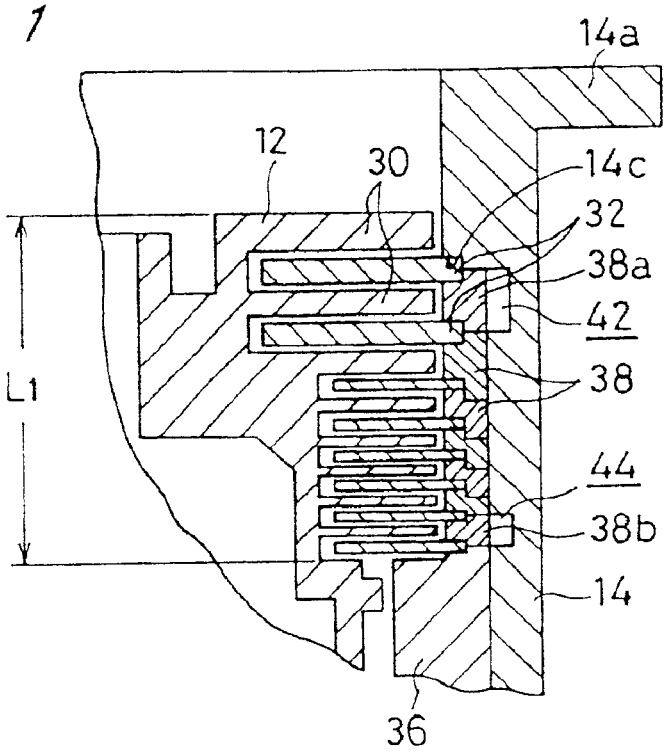
FIG. 1 is a cross sectional view of a turbo-molecular pump in a first embodiment.
Figure 2:
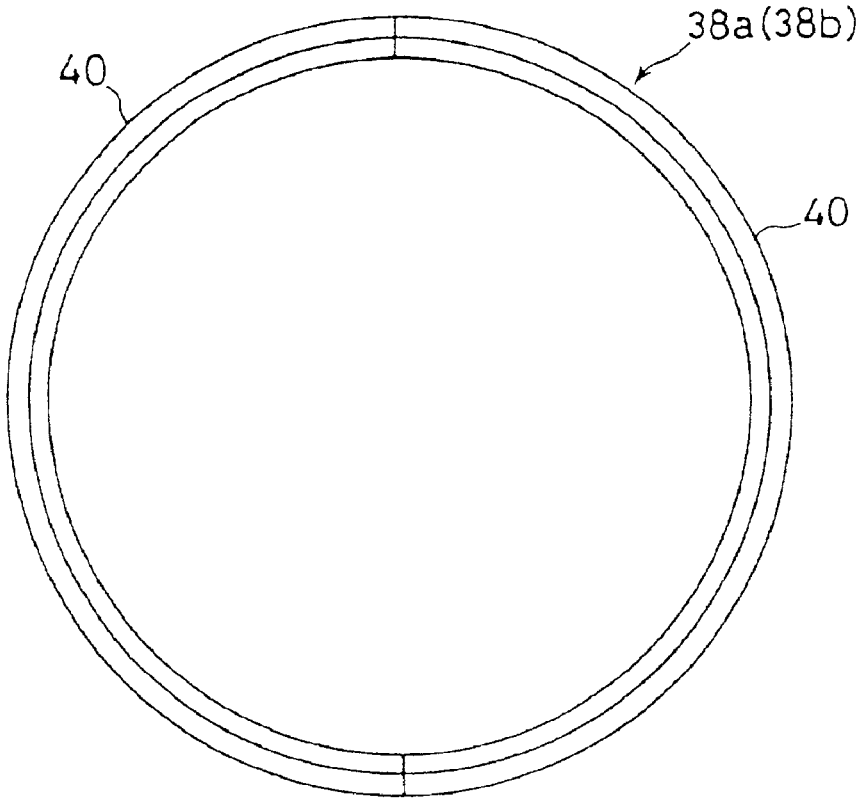
FIG. 2 is a plan view of a stator vane spacer used in the uppermost stage and the lowermost stage of the vane pumping section shown in FIG. 1.

FIGS. 1 and 2 relate to the first embodiment of the turbo-molecular pump. The present pump shares some common structural features with the conventional pump shown in FIG. 13, such as vane pumping section $L_1$ comprised by alternating rotor vanes 30 and the stator vanes 32, the groove pumping section $L_2$ having spiral groove section 34 and groove pumping section spacer 36. As well, the pump casing 14 is used to press down the stator vanes 32, stator vane spacers 38 and the groove pumping section spacer 36. Therefore, an overall illustration of this embodiment is omitted.

In the present pump is constructed so that, when abnormal torque is applied to the stator vane due to abnormal conditions developing in any rotor components, a part of the stator vane spacers 38 is able to move radially outward. This is achieved by having the uppermost vane spacer 38*a* and the lowermost vane spacer 38*b* each of which is comprised by vane spacer halves 40. The inner surface of the casing 14 has grooves 42, 44 extending all around its circumference at corresponding heights with that of the outer surfaces of the uppermost and lowermost vane spacers 38*a*, 38*b*. The width of the grooves 42, 44 is slightly larger than the thickness of the stator vane spacers 38*a*, 38*b*.

During the normal operation of such a pump, no large torque will be applied to either the stator vanes 32 or the stator vane spacers 38 in the circumferential or radial direction, and the assembly, consisting of stator vanes 32 and stator vane spacers 38, retain their positions because of mutual friction therebetween. Stator vane spacers 38*a*, 38*b* retain their ring shape, and hold individual stator vanes 32 in contact with the associated stator vane spacers 38.

If an abnormal condition should develop in the rotation of the rotor R or if the rotor R should break for whatever reason, and either or both of the stator vane spacers 38*a*, 38*b* are subjected to a large force acting in circumferential or radial direction, stator vane spacers 38*a*, 38*b* are pushed outwards, and the upper and lower split spacers 40 are separated into half pieces and the half pieces enter into the grooves 42, 44. In this condition, other stator vane spacers 38 become loose and rotatable because of a the release of a constrict in an axial direction. This causes the stator vanes 32 and the stator vane spacers 38 to be dragged with the rotor R, and causes the rotation energy of the rotor R to be gradually dissipated, and the rotor R eventually stops. Because of the release of an axial constrict of the stator vanes 32 and stator vane spacers 38 against the casing 14, damage to casing 14 or to connection to an external facility is not produced.

In the embodiment presented above, the uppermost and the lowermost stator vane spacers 38*a*, 38*b* are made into split rings, but having even only one as the split type spacer is enough for the purpose of invention, and also, any one or more of the spacers 38 disposed in the mid-section of the rotor R can be selected as the split type spacer. It is also possible to split the spacers into more than two pieces.

Figure 3:
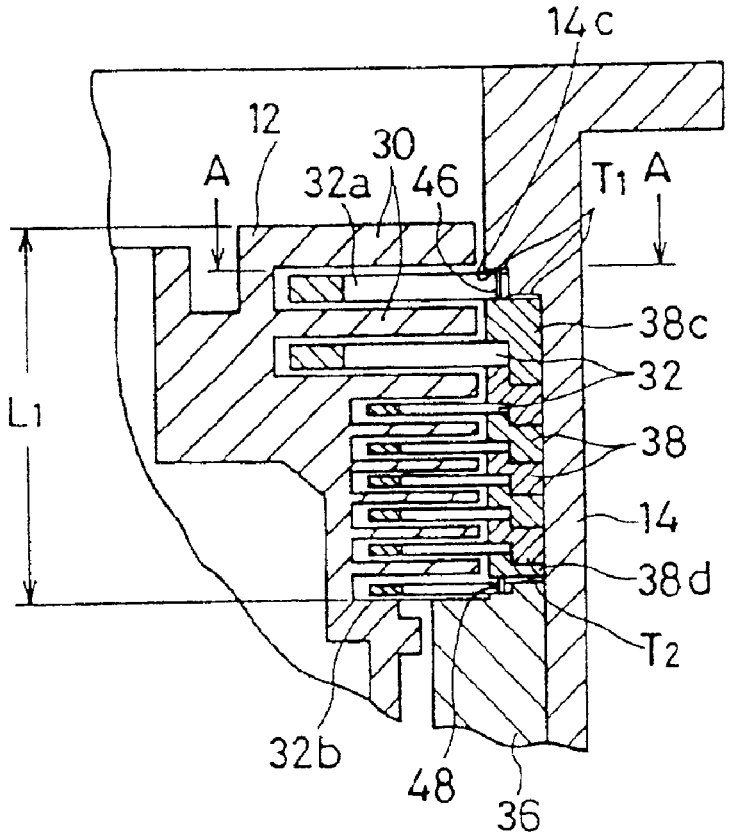
FIG. 3 is a cross sectional view of a turbo-molecular pump in a second embodiment.
Figure 4:
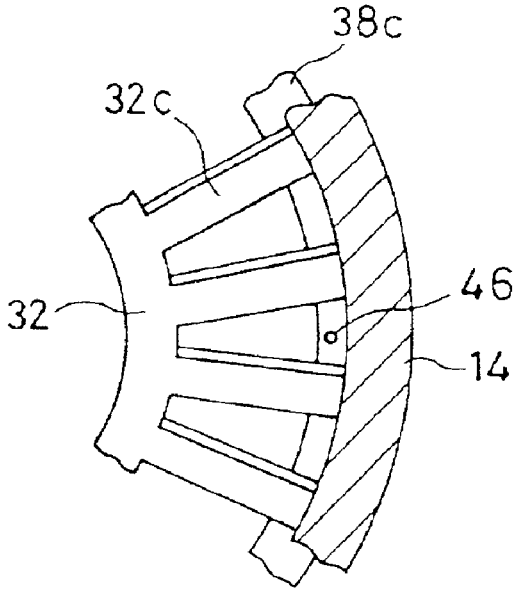
FIG. 4 is a cross sectional view through a plane A—A in FIG. 3.

FIGS. 3 and 4 show a second embodiment of the turbomolecular pump according to the invention. This pump is also constructed so that the axial constrict of the stator vane 32 is released at an early stage of the onset of an abnormal condition. As shown in FIG. 4, a plurality of support pins 46 are provided equally spaced in the circumferential direction in a space between the vanes 32*c* of the uppermost stator vane 32*a*. Similar support pins 48 are also provided in a space between the vanes 32*c* of the lowermost stator vanes 32.

With reference to FIG. 3, the support pins 46 are fitted between the step surface 14*c* of the casing 14 and the uppermost stator vane spacer 38*c* as a "support rod". The length of the pins is chosen to be slightly greater than the thickness of the uppermost stator vane 32*a*. Similarly support pin 48 is fitted between the groove pumping section spacer 36 and the lowermost stator vane spacer 38*d* and its length is made slightly larger than the thickness of the lowermost stator vane 32*b*. Therefore, a clearance $T_1$ is formed between the uppermost stator vane 32*a* and the step surface 14*c* and a clearance $T_2$ is formed between the lowermost stator vane spacer 38*d* and the lowermost stator vane 32*b*.

These support pins 46, 48 are made in such a way that, during normal operation of the pump, they are sufficient in their strength and number to support the stator vane spacers 38 in place, and if some abnormal condition should develop, such as twist of the rotor R or torque on the stator S by the rotor R, then the pins can be readily broken. Also, the sizes of the clearance $T_1$, $T_2$ are chosen to be in a range of about 50–100 mm such that, during normal operation, the stator vanes 32*a* do not experience any slack.

Such a pump operates as follows. During normal operation, the pump will remain in the condition illustrated in FIG. 3, but if the rotor R should break or experience abnormal rotation to cause some twist or torque to be developed between the stator S and the rotor R, the support pins 46, 48 will either fall down or break. This causes the clearances $T_1$, $T_2$ to be spread among the stator vanes 32 and stator vane spacers 38, thereby the assembly becomes loose and releases the axial constricting force which had been exerted on the assembly. The result is that the stator vane spacers 38 become rotatable with the impeller, which reduces the chances of torque being transmitted to the casing components, thereby preventing damage to the pump. Although top and bottom pins 46, 48 are provided in this embodiment, it is permissible to provide such pins at either end of the vane pumping section $L_1$.

Figure 5:
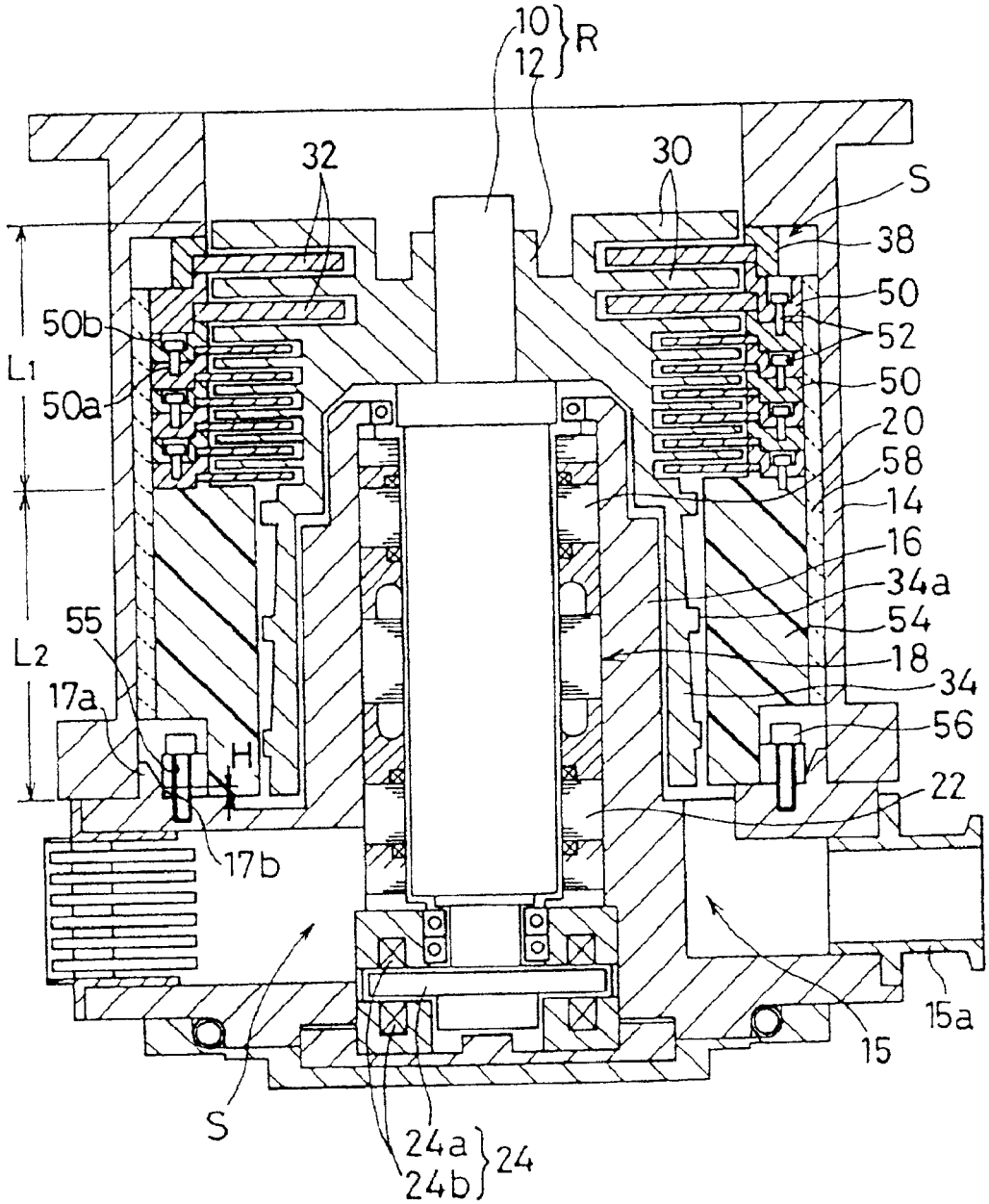
FIG. 5 is a cross sectional view of a turbo-molecular pump in a third embodiment.
Figure 6:
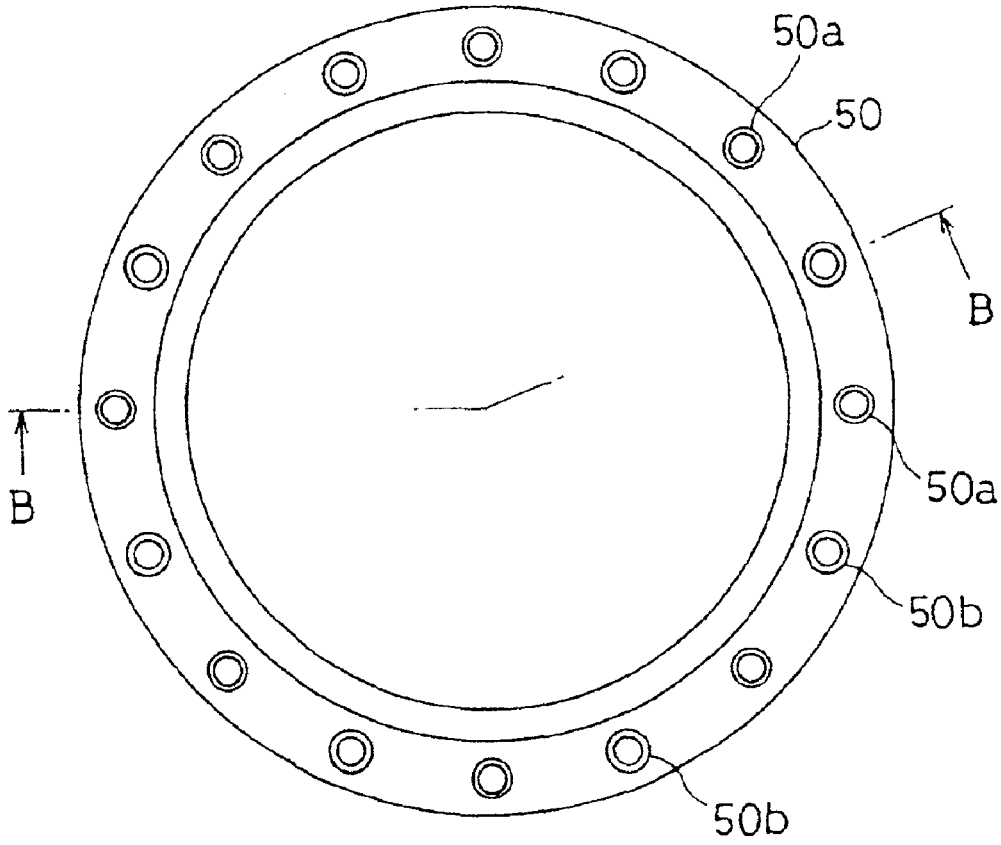
FIG. 6 is a plan view of a rotor vane spacer shown in FIG. 5.
Figure 7:
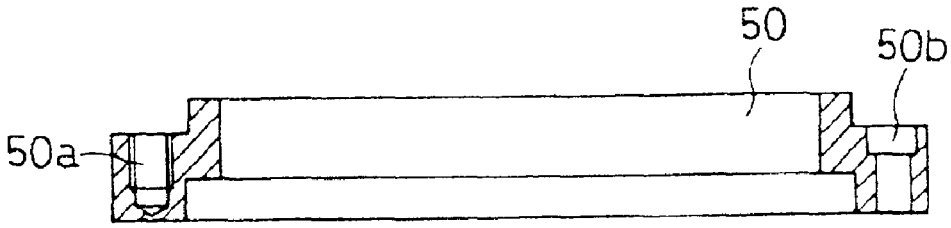
FIG. 7 is a cross sectional view through a plane B—B in FIG. 6.

FIGS. 5 to 7 show a third embodiment of the turbomolecular pump according to the invention. In this pump, all the stator vane spacers 50, excepting the uppermost stator vane spacer, are provided with a series of threaded holes 50*a* and bolt holes 50*b* alternately distributed in a circumferential direction so that a shear bolt 52 can be inserted through a bolt hole 50*b* of an upper stator vane spacer 50 to be fastened into a threaded holes 50*a* of a lower stator vane spacer 50 so as to assemble all the stator vane spacers 50 to each other. The lowermost stator vane spacer 50 is fixed to the top of the groove pumping section spacer 54 also by shear bolts 52.

The strength of the shear bolts 52 is selected such that, when abnormal torque is transmitted to the spacer 50 due to breaking of the rotor R or abnormal rotation, they will fracture. The bolt strength is determined either by selecting the material or diameter, or by providing a notch on the shear bolts 52.

Groove pumping section spacer 54 in the groove pumping section $L_2$ is fixed to the base section 15 of the stator S by inserting shear bolt 56 through a bolt receiving slit 55 and screwing the shear bolt 56 into the base section 15. The strength of the bolt 56 is selected so that it will break when torque of a certain magnitude is transmitted to the spacer 54.

Figure 13:
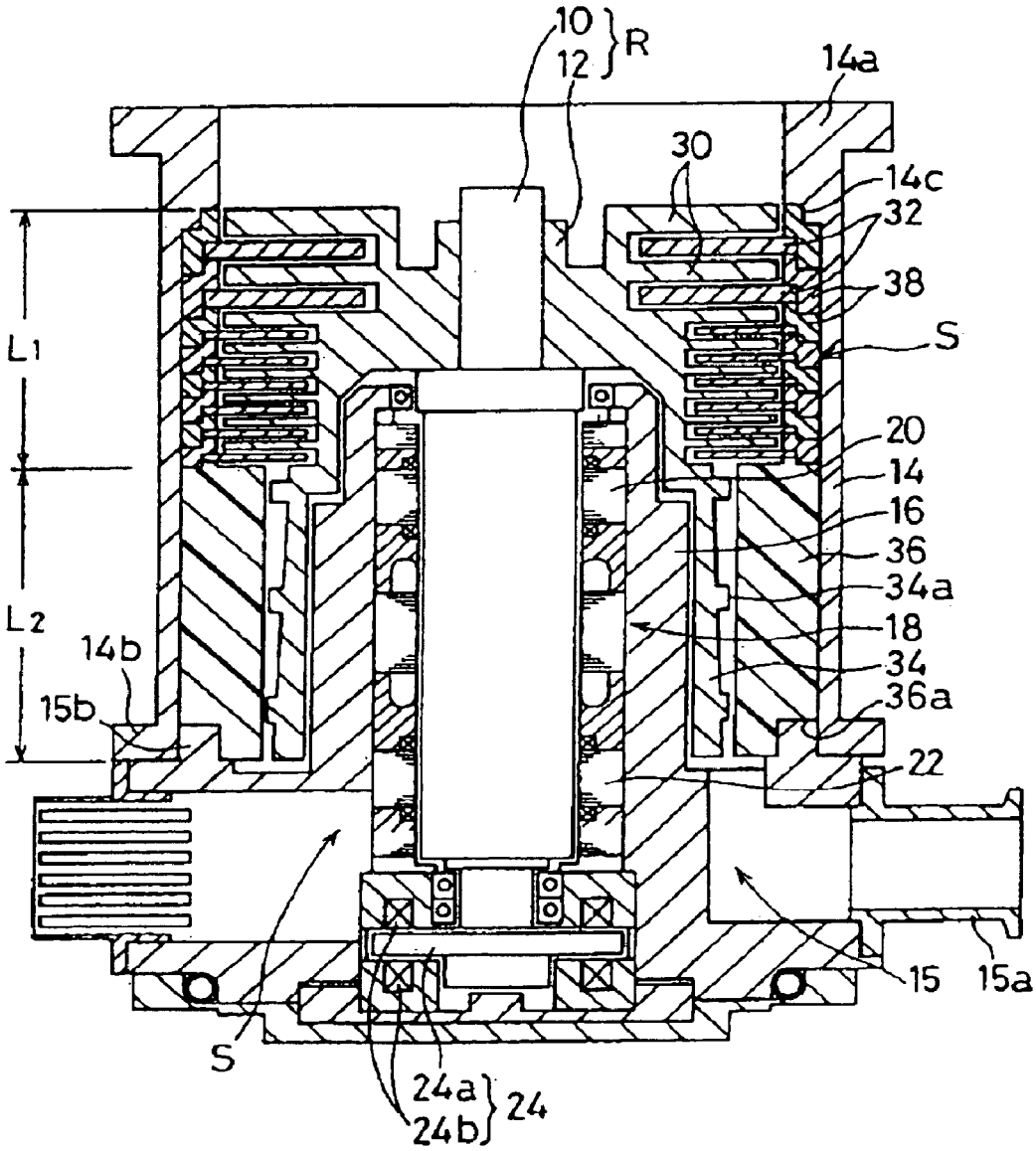
FIG. 13 PRIOR ART
FIG. 13 is a cross sectional view of a conventional turbo-molecular pump.

In this embodiment, the inside corners of the protrusion 17*a* which supports the bottom end of the groove pumping section spacer 54 are chamfered, and the height H of the contact surface 17*b* contacting the bottom end of the groove pumping section spacer 54 is made shorter than the case shown in FIG. 13. Also, a friction reducing device is provided in the form of a cylinder-shaped low-friction sleeve 58 which is made of a low friction material disposed in the space formed between the spacers 50, 54 and the casing 14.

Such a pump operates as follows. When abnormal torque acts on the stator vane spacers 50 or groove pumping section spacer 54, the shear bolts 52, 56 fastening the stator vane spacers 50 and groove pumping section spacer 54 to the stator S are fractured, thus releasing the axial compression to enable the stationary members to rotate with the impeller. This causes the energy of the rotor R to be dissipated, and lowers the torque transmitted from the rotor R to the stator S, thus preventing damage to the stator S.

Also, because the friction reducing devices 58 is provided in the space between the casing 14 and the stator vane spacers 50/groove pumping section spacer 54, frictional force resulting between the casing 14 and stator vane spacers 50/groove pumping section spacer 54 is reduced. Also, because the contact area between the base section 15 and the groove pumping section spacer 54 is made small, the force transmitted to the stator S is further reduced. The purpose of providing a circumferential groove 42 opposite the outer edge of the uppermost stator vane spacer 38 has been explained in the first embodiment.

Figure 8:
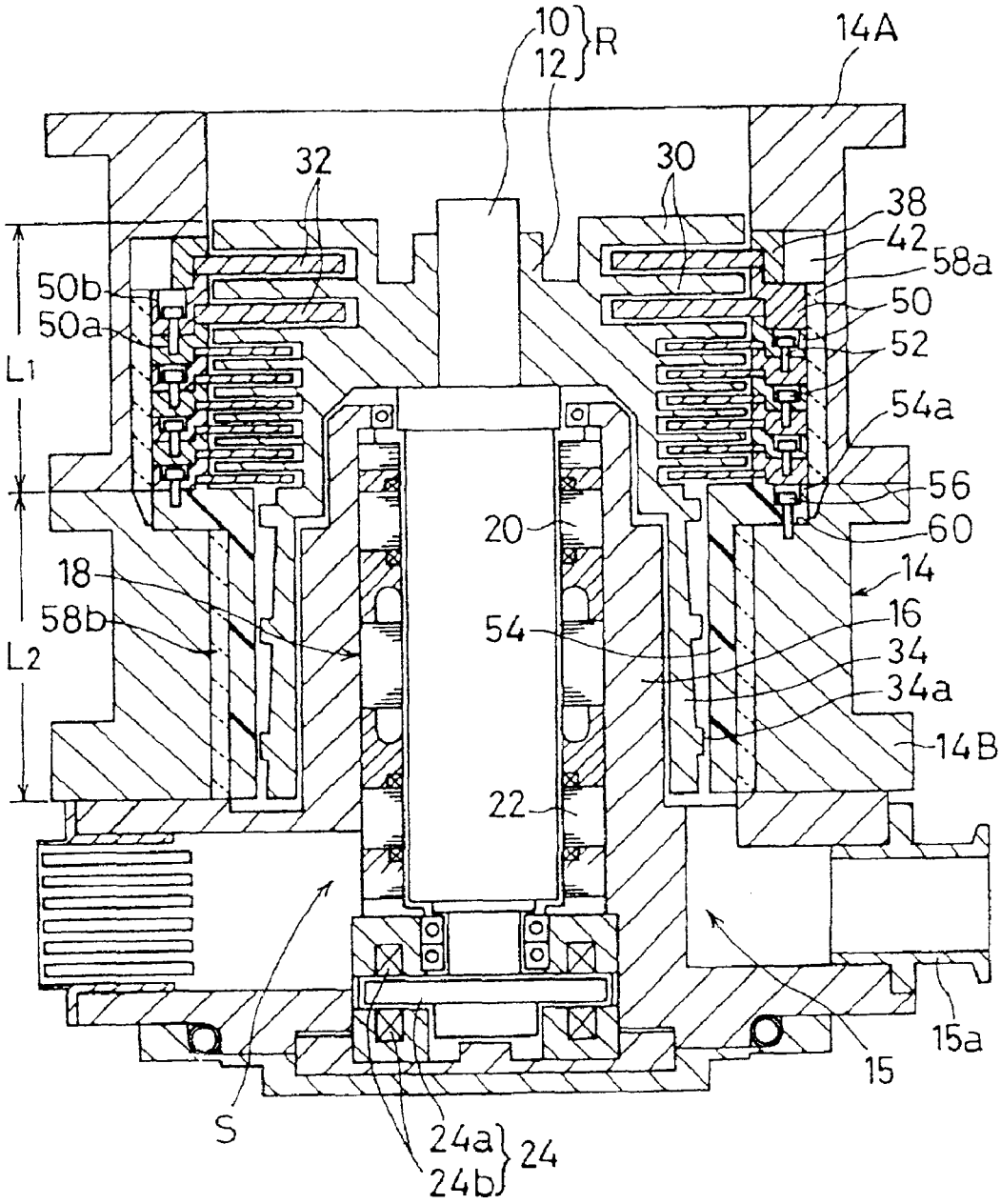
FIG. 8 is a cross sectional view of a turbo-molecular pump in a fourth embodiment.

FIG. 8 shows a fourth embodiment of the pump according to the invention. The casing 14 in this case is made of an intake-side casing 14A and an exhaust-side casing 14B, which are attached to form a complete casing 14. Stator vane spacers 50 in the vane pumping section $L_1$ are axially fixed layer by layer by using shear bolts 52 as in the previous embodiment.

The exhaust side casing 14B has a step surface 60 at the top end, and the groove pumping section spacer 54 has a flange section 54*a*, so that the groove pumping section spacer 54 is attached to the exhaust-side casing 14B by fastening the step surface 60 to the flange section 54*a* by bolts 56. The strength of the bolts 56 is selected such that they will break at a given torque. In this embodiment also, cylinder-shaped friction reducing sleeves 58*a*, 58*b* are provided in the spaces between the stator vanes 50 and the intake-side casing 14A on the one hand, and the groove pumping section spacer 54 and the exhaust-side casing 14B on the other hand. The turbo-molecular pump of this embodiment provides the same protective effects described above.

Figure 9:
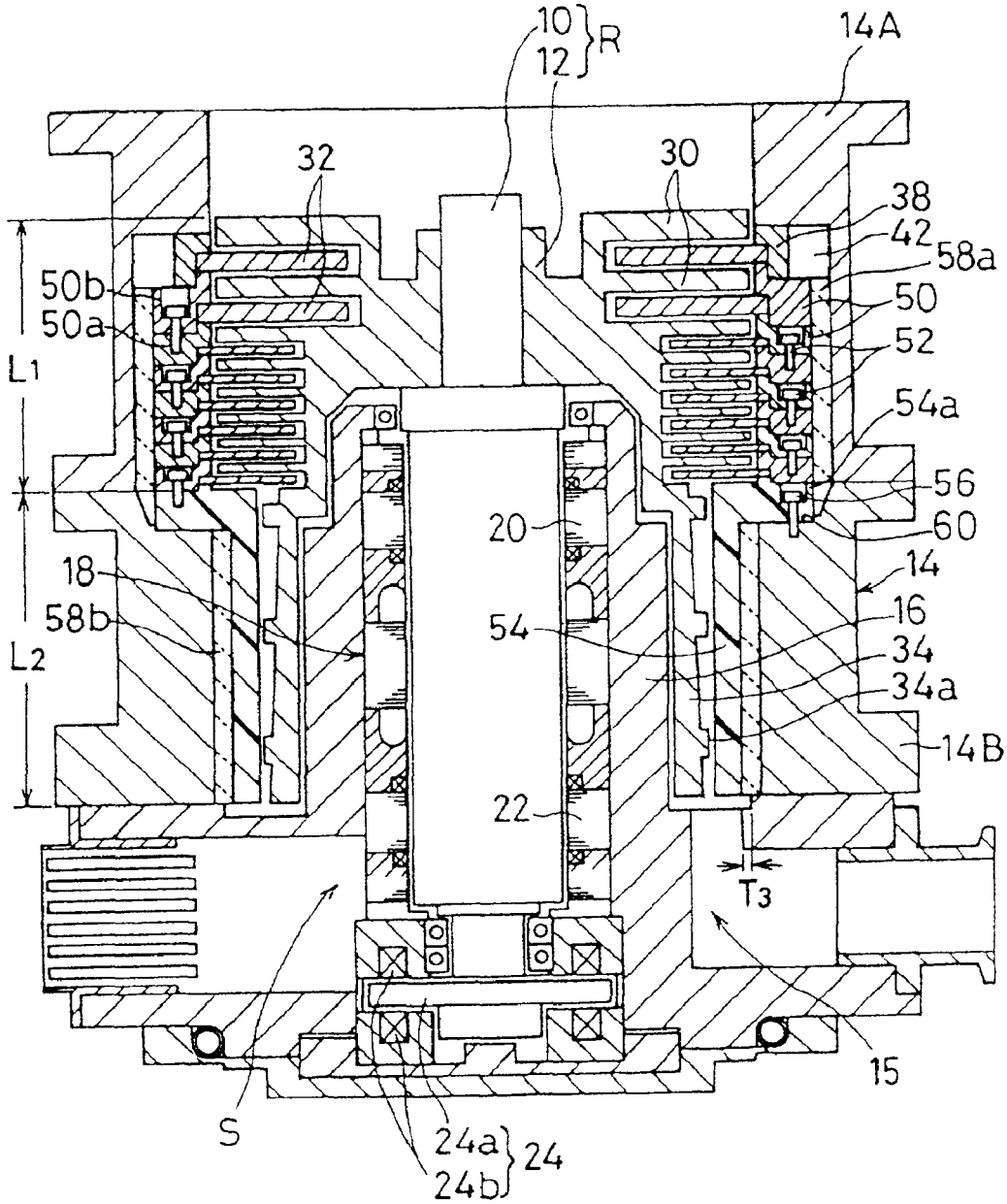
FIG. 9 is a cross sectional view of a variation of the pump shown in FIG. 8.

FIG. 9 shows a variation of the fourth embodiment shown in FIG. 8. Groove pumping section spacer 54 in the groove pumping section of this pump is attached by bolting the top flange section 54*a* to the step surface 60 at the top end of the exhaust-side casing 14B as in the previous embodiment. Friction reducing sleeves 58*a*, 58*b* are provided in the spaces formed in the intake-side casing 14A and likewise in the exhaust-side casing 14B. In the previous embodiment, the bottom end of the groove pumping section spacer 54 contacted the inside surface of the base section 15 to produce the circumferential constricting force, but in this embodiment, there is a clearance $T_3$ between the outer periphery of the bottom end of the spacer 54 and the inner edge of the base section 15 of the stator S so that the groove pumping section spacer 54 is not restrained directly by the casing. The reason is as follows.

For those turbo-molecular pumps that have vane pumping section $L_1$ and the groove pumping section $L_2$ made into an integral unit, damage to the rotor R is most likely to occur at the bottom end of the groove pumping section. Firstly, this is because the top end of the spiral groove section 34 is constrained by the vane pumping section $L_1$, but the bottom end is not restrained. Therefore the elastic deformation caused by the mass of the high speed rotor R is greater towards the bottom side of the pump unit. Secondly, the bottom section of the spiral groove section 34 is subjected to a high pressure process gases used in semiconductor device manufacturing, making this section susceptible to corrosion, and consequently this section is vulnerable to cracks by stresses resulting from elastic deformation.

When the groove pumping section spacer 54 is deformed outward in a pump unit having its bottom end of the groove pumping section spacer 54 fixed to or contacting the casing 14B, as shown in FIG. 8, the contact section will resist the deformation and the circumferential stress is transmitted directly to the casing. In contrast, in this variation of the pump, there is a clearance $T_3$ provided between the bottom end of the groove pumping section spacer 54 and the casing 14B, so that a small degree of elastic deformation is not sufficient to make them contact, and the spacer 54 can rotate while sliding by way of the friction reducing sleeve 58*b*, thereby dissipating the rotational energy.

Figure 10:
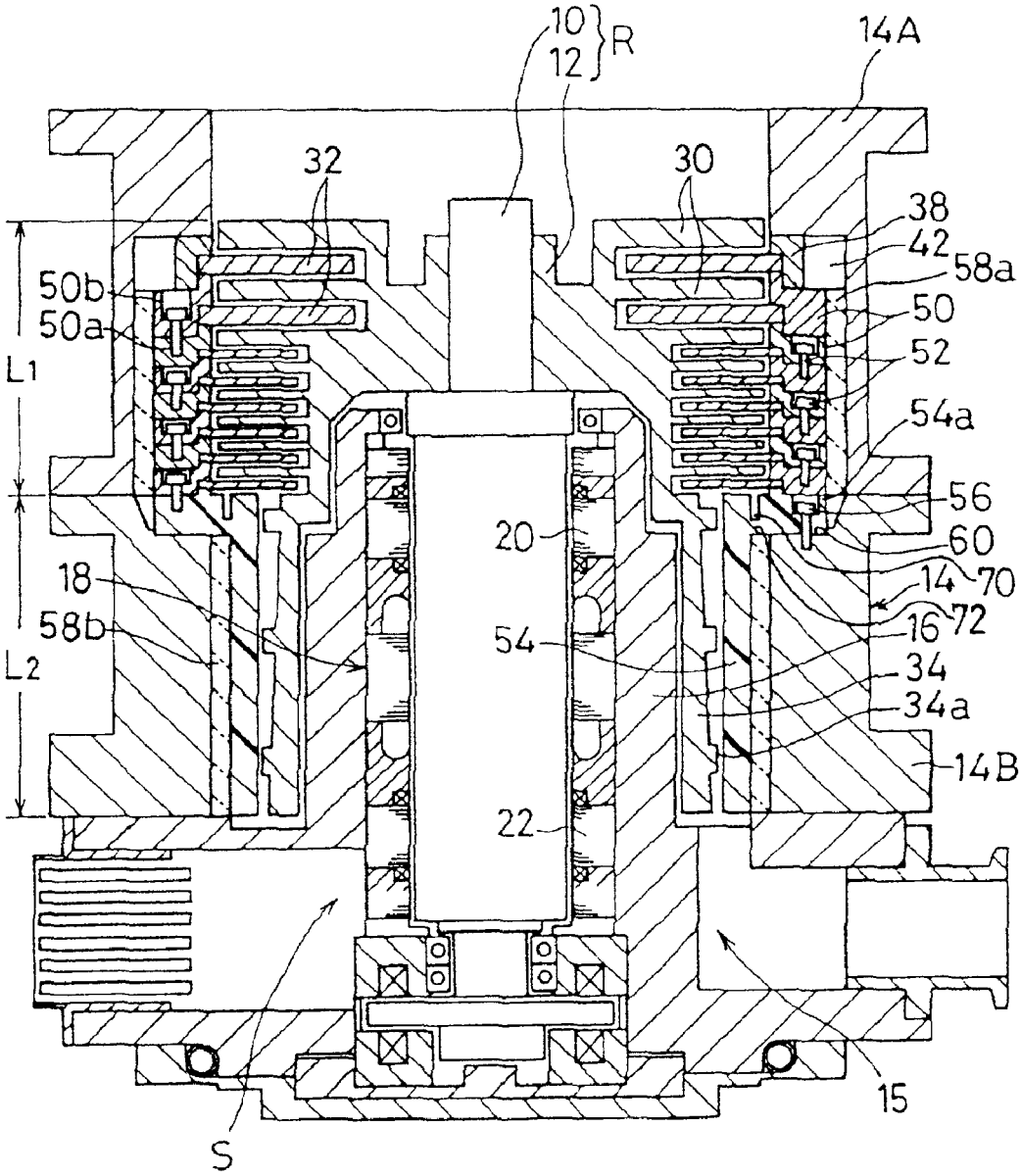
FIG. 10 is a cross sectional view of another variation of the pump shown in FIG. 8.

FIG. 10 shows a further variation of the pump shown in FIG. 8, and includes a fragile section 72 comprised by a notched fracturing groove section 70 extending in the circumferential direction provided at the boundary between the groove pumping section spacer 54 and the flange section 54*a* for relieving the stress by fracturing. This variation of the fourth embodiment provides constriction release by breaking at the fragile section 72 along the fracturing groove section 70 when an abnormal torque exceeding a threshold value is applied to the groove pumping section spacer 54, leading the main section of the groove pumping section spacer 54 to be separated from the flange section 54*a*. In this condition, the groove pumping section spacer 54 rotates with the rotor R along the low friction sleeve 58*b* to gradually dissipate its rotational energy.

Figure 11:
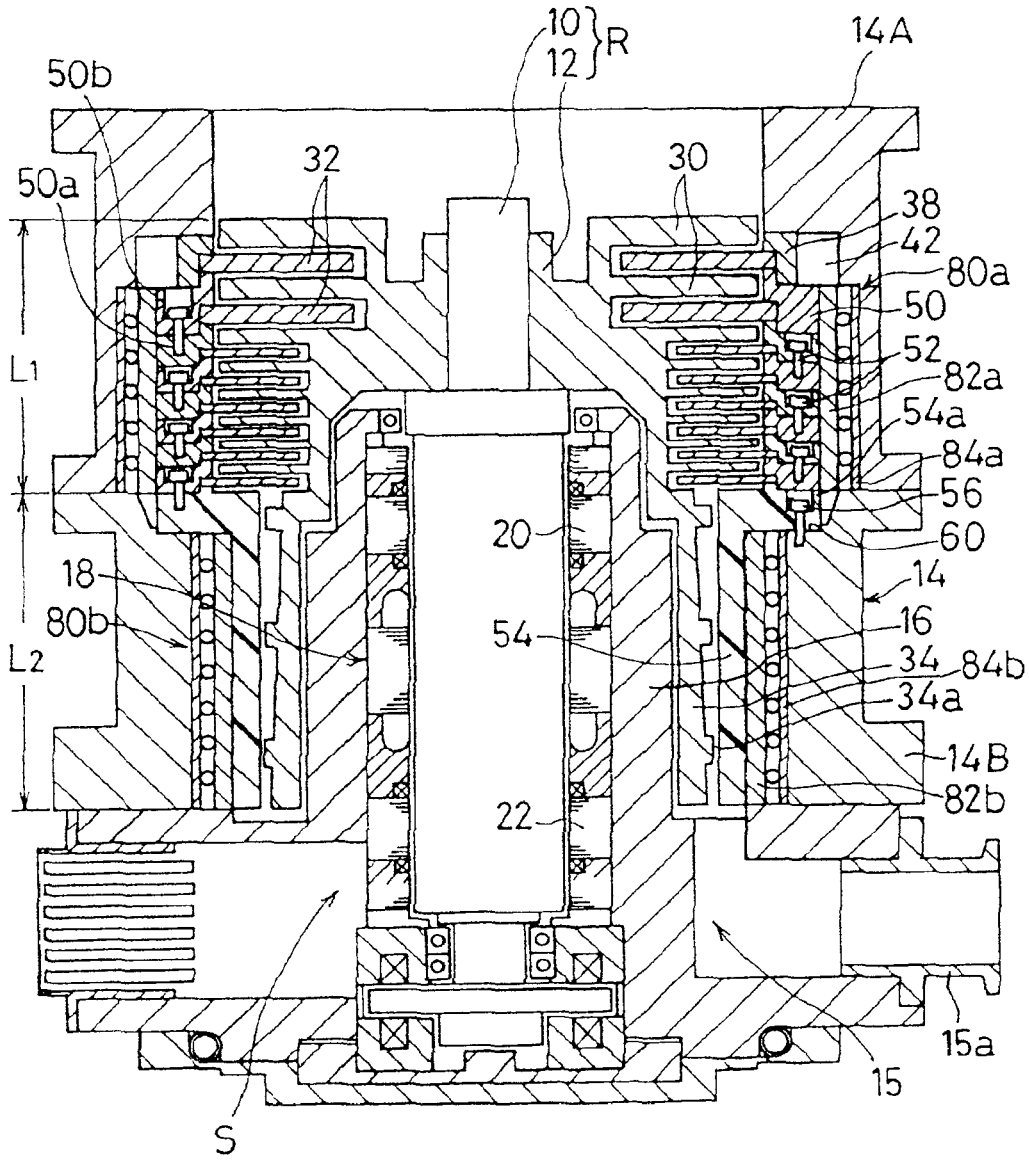
FIG. 11 is a cross sectional view of a turbo-molecular pump in a fifth embodiment.

FIG. 11 shows a fifth embodiment of the pump comprised by a split casing 14 having an intake-side casing 14A and an exhaust-side casing 14B, and a ball bearing devices (friction reducing structure) 80*a*, 80*b*, respectively, between the stator vane spacers 50 and the intake-side casing 14A on the one hand, and between the groove pumping section spacer 50 and the exhaust-side casing 14B on the other hand. These ball bearing devices 80*a*, 80*b* are comprised by inner sleeves 82*a*, 82*b* and outer sleeves 84*a*, 84*b* with bearing balls therebetween. The inner sleeves 82*a*, 82*b* are made thicker, and therefore, stronger than the outer sleeves 84*a*, 84*b*.

Protective mechanism of this embodiment is as follows. Because the inner sleeves 82*a*, 82*b* are made stronger than the outer sleeves 84*a*, 84*b*, if abnormal conditions develop on the rotor components of the rotor R or its debris impact upon the stator S to apply high local stresses to the stator S, the inner sleeves 82*a*, 82*b* are able to withstand the stresses so that the ball bearing device 80 can continue to operate relatively undisturbed. It should be noted that the outer sleeves 84*a*, 84*b* are supported by the casings 14A, 14B so that the deformation is small and their traces of revolution will remain essentially intact even though they are thinner.

It is permissible to use rollers instead of balls in the bearing device, and in this case also, the inner sleeves should be made thicker than the outer sleeves to achieve the same effect as above.

Figure 12A:
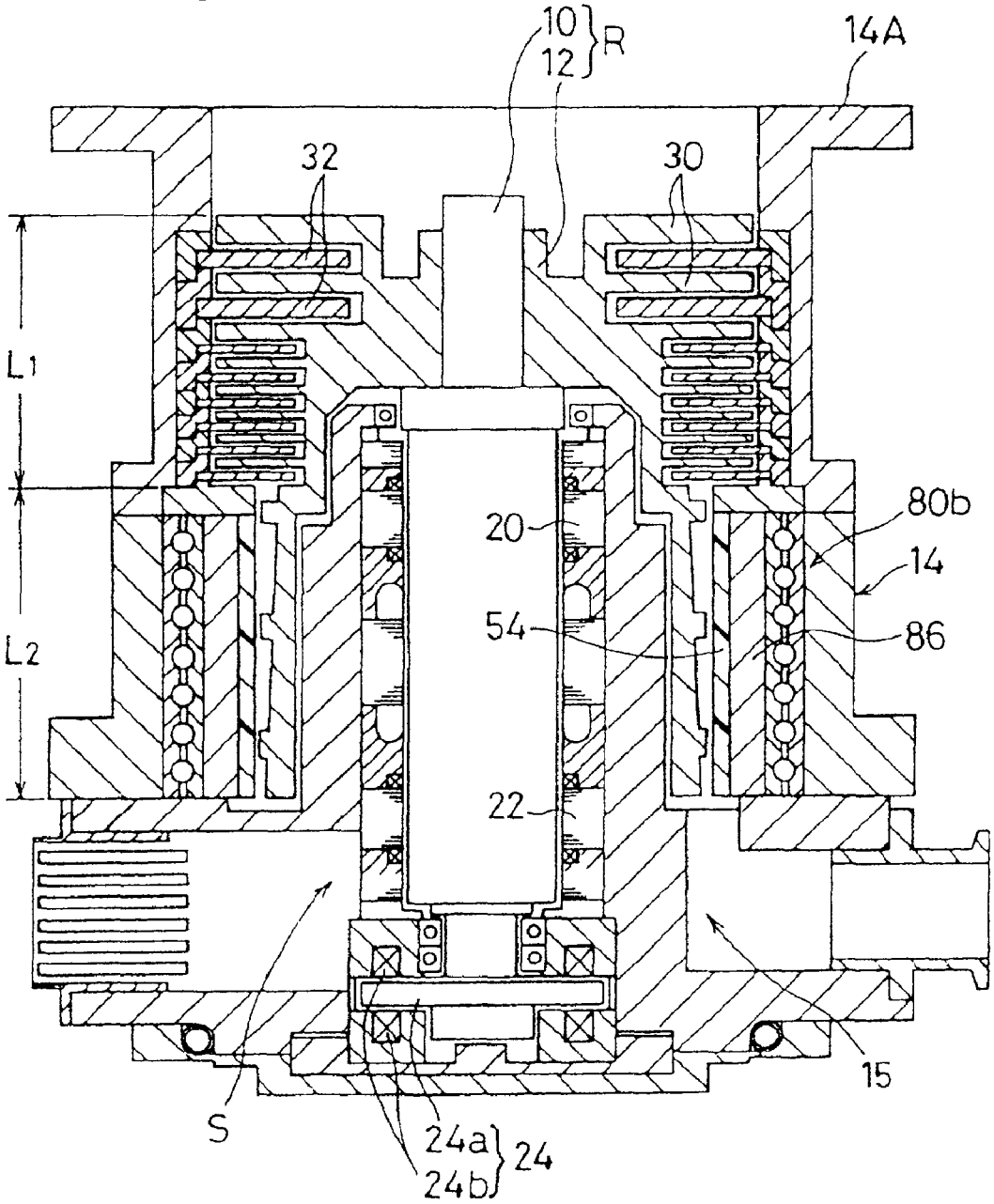
FIG. 12A is a cross sectional view of a turbo-molecular pump in a sixth embodiment.

FIG. 12A shows a sixth embodiment which is an improvement in the pump structure presented in FIG. 11. In this pump unit, the groove pumping section $L_2$ is provided with an impact absorbing member (impact absorbing structure) 86 between the groove pumping section spacer 54 and the ball bearing device 80*b*. Suitable material for the impact absorbing member 86 are soft metals, polymeric materials or their composite materials. By providing an impact absorbing material between the stator S and pump casing 14, stress transmission from the stator S to the casing 14 can be prevented to avoid damaging the casing 14 or to the vacuum processing system. By using both the friction reducing structure such as ball bearing device 80*b* and the impact absorbing structure, even greater advantages may be obtained.

Figure 12B:
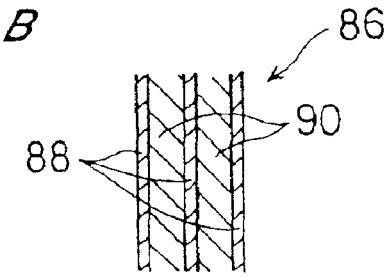
FIG. 12B is a cross sectional view of another configuration of the impact absorbing structure.

FIG. 12B shows a composite structure of an impact absorbing member 86 made of a tough material such as stainless steel, and an impact absorbing member 90 made of a soft but high impact absorbing material, thus providing both impact absorbing function and shape retaining function.

It should be noted that, in the foregoing embodiments, the application of damage prevention to turbo-molecular pump was represented by those pumps having a vane pumping section $L_1$ and groove pumping section $L_2$. However, depending on the nature of the processing facilities under consideration, the damage prevention structure can be applied to those pumps having only the vane pumping section $L_1$ or only the groove pumping section $L_2$. For those wide-range pumps having both pumping sections $L_1$ and $L_2$, it is understandable that the damage prevention structure can be provided only on one of the two pumping sections. It is equally understandable that a combination of any of the embodied structures can be combined in any suitable combination to either or both pumping sections $L_1$ and $L_2$.

What is claimed is:

1. A turbo-molecular pump, comprising:

a pump casing housing a stator and a rotor therein, said pump casing being provided concentrically with at least one of said stator and said rotor, and at least a part of said stator held in place by a constriction;

at least one of a vane pumping section and a groove pumping section comprised by said stator and said rotor; and a constriction releasing structure for releasing said constriction of at least a part of said stator when an abnormal torque is applied to said stator by an abnormal condition of said rotor itself.

2. A turbo-molecular pump comprising:

a pump casing housing a stator and a rotor therein, said pump casing being provided concentrically with at least one of said stator and said rotor;

at least one of a vane pumping section and a groove pumping section comprised by said stator and said rotor; and a constriction releasing structure for releasing constriction of at least a part of said stator when an abnormal torque is applied to said stator by an abnormal condition of said rotor itself, wherein said stator constituting said groove pumping section includes a cylindrical section, and a flange section for fixing said stator to said pump casing, and said constriction releasing structure comprises a fragile section formed in at least a part of said stator and said fragile section is distributed in a circumferential direction in said flange section.

3. A turbo-molecular pump according to claim 1, wherein said stator constituting said groove pumping section includes a cylindrical section, and only an end of said cylindrical section which connects said groove pumping section to said vane pumping section is fixed to said pump casing and the other end of said cylindrical section is spaced from said pump casing.

4. A turbo-molecular pump comprising:

a pump casing housing a stator and a rotor therein, said pump casing being provided concentrically with at least one of said stator and said rotor;

a vane pumping section comprised by said stator and said rotor; and a friction reducing structure including a first component provided in at least a part of a space radially between said stator of said vane pumping section and said pump casing for facilitating relative sliding movement therebetween.

5. A turbo-molecular pump according to claim 4, wherein said friction reducing structure comprises one of a friction reducing member made of a material having a low friction coefficient and a mechanical bearing.

6. A turbo-molecular pump according to claim 4, further comprising:

a groove pumping section comprised by said stator and said rotor;

wherein said friction reducing structure includes a second component provided in at least a part of a space radially between said stator of said groove pumping section and said pump casing for facilitating relative sliding movement therebetween.

7. A turbo-molecular pump according to claim 6, wherein said friction reducing structure comprises one of a friction reducing member made of a material having a low friction coefficient and a mechanical bearing.

8. A turbo-molecular pump comprising:

a pump casing housing a stator and a rotor therein;

a vane pumping section and a groove pumping section comprised by said stator and said rotor; and a friction reducing structure provided in at least a part of a space between said stator and said pump casing for allowing said stator of said vane pumping section and said groove pumping section to rotate when an abnormal torque is applied to at least a part of said stator by said rotor.

9. A turbo-molecular pump according to claim 8, wherein said friction reducing structure comprises one of a friction reducing member made of a material having a low friction coefficient and a mechanical bearing.

10. A turbo-molecular pump according to claim 8, wherein said stator constituting said groove pumping section includes a cylindrical section, and only an end of said cylindrical section which connects said groove pumping section to said vane pumping section is fixed to said pump casing and the other end of said cylindrical section is spaced from said pump casing.

11. A turbo-molecular pump comprising:

a pump casing housing a stator and a rotor therein;

a vane pumping section and a groove pumping section comprised by said stator and said rotor; and a friction reducing structure provided in at least a part of a space between said stator and said pump casing for allowing said stator of said vane pumping section and said stator of said groove pumping section to rotate together when an abnormal torque is applied to at least a part of said stator by said rotor.

12. A turbo-molecular pump according to claim 11, wherein said friction reducing structure comprises one of a friction reducing member made of a material having a low friction coefficient and a mechanical bearing.

13. A turbo-molecular pump according to claim 11, wherein said stator constituting said groove pumping section includes a cylindrical section, and only an end of said cylindrical section which connects said groove pumping section to said vane pumping section is fixed to said pump casing and the other end of said cylindrical section is spaced from said pump casing.

14. A turbo-molecular pump comprising:

a pump casing housing a stator and a rotor therein, said pump casing being provided concentrically with at least one of said stator and said rotor; and at least one of a vane pumping section and a groove pumping section comprised by said stator and said rotor;

wherein a constriction is released and at least a part of said stator is adapted to rotate when an abnormal torque is applied to at least a part of said stator by an abnormal condition of said rotor itself.

15. A turbo-molecular pump comprising:

a pump casing housing a stator and a rotor therein, said pump casing being provided concentrically with at least one of said stator and said rotor; and at least one of a vane pumping section and a groove pumping section comprised by said stator and said rotor;

wherein when an abnormal torque is applied to at least a part of said stator by an abnormal condition of said rotor itself, a constriction is released and at least a part of said stator is adapted to rotate so that said abnormal torque is reduced.

16. A turbo-molecular pump comprising:

a pump casing housing a stator and a rotor therein; and a vane pumping section and a groove pumping section comprised by said stator and said rotor;

wherein at least a part of said stator of said vane pumping section and said groove pumping section is adapted to rotate when an abnormal torque is applied to at least a part of said stator by said rotor.

17. A turbo-molecular pump comprising:

a pump casing housing a stator and a rotor therein; and a vane pumping section comprised by said stator and said rotor, said vane pumping section comprising a plurality of stator vanes and a plurality of stator vane spacers for fixing said stator vanes;

wherein at least a part of said stator vanes and said stator vane spacers is adapted to rotate when an abnormal torque is applied to at least a part of said stator by said rotor.

18. A turbo-molecular pump comprising:

a pump casing housing a stator and a rotor therein;

a vane pumping section comprised by said stator and said rotor, said vane pumping section comprising a plurality of stator vanes and a plurality of stator vane spacers for fixing said stator vanes; and a cylindrical member provided so as to enclose said stator vane spacers;

wherein said cylindrical member is adapted to allow said stator vane spacers to rotate when an abnormal torque is applied to said stator vane spacers.

19. A turbo-molecular pump comprising:

a pump casing housing a stator and a rotor therein;

a groove pumping section comprised by said stator and said rotor; and a cylindrical member provided so as to enclose said stator of said groove pumping section;

wherein a constriction is released and said cylindrical member is adapted to allow said stator of said groove pumping section to rotate when an abnormal torque is applied to said stator of said groove pumping section by an abnormal condition of said rotor itself.

20. A turbo-molecular pump comprising:

a pump casing housing a stator and a rotor therein;

a vane pumping section and a groove pumping section comprised by said stator and said rotor, said vane pumping section comprising a plurality of stator vanes and a plurality of stator vane spacers for fixing said stator vanes;

a cylindrical member provided so as to enclose said stator vane spacers, said cylindrical member being adapted to allow said stator vane spacers to rotate when an abnormal torque is applied to said stator vane spacers; and a cylindrical member provided so as to enclose said stator of said groove pumping section, said cylindrical member being adapted to allow said stator of said groove pumping section to rotate when an abnormal torque is applied to said stator of said groove pumping section;

wherein said two cylindrical members are connected to each other.

21. A turbo-molecular pump comprising:

a pump casing housing a stator and a rotor therein; and at least one of a vane pumping section and a groove pumping section comprised by said stator and said rotor;

wherein at least a part of said stator is fixed to said pump casing through a fragile section, and said fragile section is adapted to be broken when an abnormal torque is applied to said stator by said rotor.

22. A turbo-molecular pump according to claim 21, wherein said fragile section comprises one of a bolt and a pin.

23. A turbo-molecular pump comprising:

a pump casing housing a stator and a rotor therein;

at least one of a vane pumping section and a groove pumping section comprised by said stator and said rotor;

wherein at least a part of said stator is fixed to said pump casing through a fragile section, and said fragile section has a function that when an abnormal torque is applied to said stator by said rotor, said abnormal torque is reduced.

24. A turbo-molecular pump according to claim 23, wherein said fragile section comprises one of a bolt and a pin.

25. A turbo-molecular pump comprising:

a pump casing housing a stator and a rotor therein;

at least one of a vane pumping section and a groove pumping section comprised by said stator and said rotor;

a friction reducing structure provided in at least a part of a space between said stator and said pump casing for facilitating relative sliding movement therebetween; and an impact absorbing structure provided inside of said friction reducing structure, wherein said impact absorbing structure has a function that when an abnormal torque is applied to said stator by said rotor, said abnormal torque is prevented from being directly transmitted from said stator to said pump casing.

26. A turbo-molecular pump according to claim 8, wherein said friction reducing structure is provided in said groove pumping section.

27. A turbo-molecular pump according to claim 8, wherein said friction reducing structure is provided in said pumping section.

28. A turbo-molecular pump according to claim 11, wherein said friction reducing structure is provided in said groove pumping section.

29. A turbo-molecular pump according to claim 11, wherein said friction reducing structure is provided in said vane pumping section.

30. A turbo-molecular pump comprising:

a pump casing housing a stator and a rotor therein, said pump casing being provided concentrically with at least one of said stator and said rotor;

at least one of a vane pumping section and a groove pumping section comprised by said stator and said rotor; and a constriction releasing structure for releasing constriction of at least a part of said stator when an abnormal torque is applied to said stator by an abnormal condition of said rotor itself, wherein said stator constituting said groove pumping section includes a cylindrical section, and a flange section for fixing said stator to said pump casing, and said constriction releasing structure comprises a fragile section formed in at least a part of said stator and said fragile section is formed in said flange section.

* * * * *